United States Patent [19]

Laukaitis

[11] Patent Number: 4,987,453

[45] Date of Patent: Jan. 22, 1991

[54] DEVELOPMENT RATE CONTROLLER

[75] Inventor: Joseph F. Laukaitis, Rochester, N.Y.

[73] Assignee: Eastman Kodak Company, Rochester, N.Y.

[21] Appl. No.: 473,530

[22] Filed: Feb. 1, 1990

[51] Int. Cl.[5] ..... G03G 15/09

[52] U.S. Cl. ..... 355/246; 355/251; 355/77; 355/203; 355/208; 118/657

[58] Field of Search ..... 355/246, 245, 251, 261–265, 355/203, 208, 77; 118/689, 690, 657, 658

[56] References Cited

U.S. PATENT DOCUMENTS

| | | | |
|---|---|---|---|
| 4,382,420 | 5/1983 | Ohnuma et al. | 118/651 |
| 4,678,317 | 7/1987 | Grossinger . | |
| 4,706,032 | 11/1987 | Allen et al. | 355/203 X |

OTHER PUBLICATIONS

Japanese patent application abstract, No. 62-299676, priority date Nov. 30, 1987.

R. M. Schaffert, Electrophotography, Focal-Press, London, 1975, pp. 574–576.

*Primary Examiner*—R. L. Moses

*Attorney, Agent, or Firm*—Milton S. Sales

[57] ABSTRACT

Apparatus and method for controlling the development rate of an electrostatic photocopying machine. An electrode plate is positioned adjacent to the toning brush to form a capacitive circuit in which a portion of the dielectric is the toner mixture used in developing images in the machine. Reversing polarities are applied to the electrode plate to alternately make it attract and repel toner. During the attracting or developing polarity, the transient behavior of the toning current is detected and this transient response is used to determine the development rate of the apparatus. In the specific embodiment described, the transient characteristic detected is the time required for the charging current to decay to a predetermined value.

16 Claims, 2 Drawing Sheets

DEVELOPMENT RATE CONTROLLER

BACKGROUND OF THE INVENTION

1. Field of the Invention

This invention relates, in general, to photocopying and, more specifically, to controlling the development process and toner concentration in electrophotographic copiers and printers.

2. Description of the Prior Art

Electrostatographic apparatus, such a electrophotographic copiers and printers, which use a dry powdered toner to develop latent images usually require some type of monitoring and controlling device for maintaining consistency in the quality of the developed image. Toner concentration monitors are frequently used and a variety of systems have been seen and described in the prior art. The need for such systems is especially important when the size of the toner particle is reduced to allow for higher resolution in the developed image.

Conventional toner monitors includes types which measure the reflectance from a test or density patch developed with the toner mixture, measure reflectance directly from the toner in the hopper. and count the amount of pixels which are developed in the image when produced by an electronic exposure device. Other monitors use plates or electrodes located in or near the toner mixture to measure the steady state resistance, capacitance, or other parameter of the toner mixture. While these have all been proclaimed to provide some degree of success, other factors in the development process make the monitoring and control difficult to protect to a high degree of preciseness and better systems are always being studied.

The development rate is dependent upon not only the concentration of the toner but also upon other factors, such as the charge-to-mass ratio of the toner, the charge distribution, and the presence of wrong-sign particles. One prior art monitoring system which can provide information for toner and/or process control which achieves partial success in this regard uses an electrode or plate positioned above a magnetically actuated sample of the developer, or tone mixture. An electrostatic field is applied between the plate and the sample holder which causes toner to be developed or deposited on the plate. This provides and indication of the charge flow and weight of the developer. As with other systems, this system uses a steady state measurement of voltage or current in the monitor to indicate the toner conditions.

Many of the monitoring methods used or described in the prior art merely control the toner concentration or process control parameters based on the amount of toner in the mixture. Other factors, such as mass, time, humidity, and charge, ultimately affect the developed image. Therefore, it is desirable, and it is an object of this invention, to provide a toner development rate monitor and controller which gives improved development performance over prior art systems.

SUMMARY OF THE INVENTION

There is disclosed herein a new and useful system for controlling the development rate in an electrostatographic copying or printing machine. Because the monitoring system disclosed herein is responsive to the actual amount of toner deposited on the capacitor electrode, a true indication of the development rate is achieved irrespective of other factors which influence development rate.

In the specific embodiment described herein, a reversing power supply is used to alternately apply developing and cleaning voltages to the capacitor electrode or plate which is positioned adjacent to the cylindrical toner brush of the machine. When the developing potential is first applied, the charging current quickly increases to a maximum value and then decays at a slower rate to eventually attain a steady state value. The time required for the charging current to decrease to a predetermined value is determined by the circuitry of this invention. This corresponds to the transient characteristics of the capacitor when the charging or developing potential is applied thereto. This time interval is equated to or correlated with the control necessary to charge the toner concentration or process parameters to give the desired toner development rate.

By alternately applying developing and cleaning potentials to the electrode and measuring the transient response, the toner concentration and process control necessary for optimum image quality can be maintained. Test results have indicated that charges in toner concentration of only a few percent produce large changes in the time necessary for the charging current to decay to the predetermined detected level.

BRIEF DESCRIPTION OF THE DRAWINGS

Further advantages and uses of this invention will become more apparent when considered in view of the following detailed description and drawings, in which.

DESCRIPTION OF THE PREFERRED EMBODIMENTS

Figure 1:
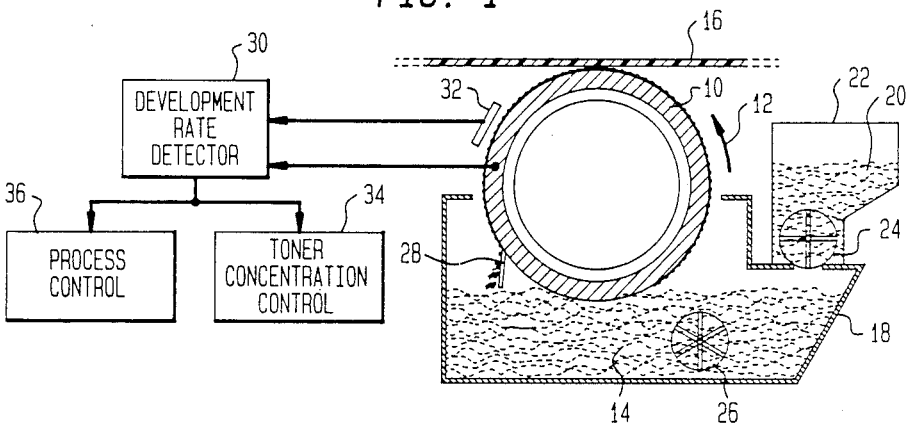
FIG. 1 is a view which illustrates a development rate controller system for use with a cylindrical toning member.

Throughout the following description, similar reference characters refer to similar elements or members in all of the figures of the drawings.

Referring now to the drawings, and to FIG. 1 in particular, there is shown a development rate controller constructed according to a specific embodiment of this invention. The development rate controller is used in conjunction with a toning member which has a cylindrical shape. In FIG. 1, the toning brush or roller 10 is rotatable in direction 12 to carry the developer mixture 14 to the photosensitive member 16 for the purpose of developing a latent image on the member 16. The developer mixture in the hopper or container 18 contains toner particles and magnetic carrier particles which are commonly used in electrophotographic processes, although other developer compositions are within the contemplation of the invention. The developer is replenished by toner particles 20 contained within the enclosure 22. Augers, valves or gates 24 and 26 are used according to conventional practice to move and permit the flow of toner throughout the containers.

The toning brush 10 is constructed of a metallic member having a cylindrical shape. The toner which is not transferred to the photosensitive member 16 is removed from the brush by the take-off skive 28 and is allowed to fall back into the container 18. It is between the transfer position to the member 16 and the take-off skive 28 that the development rate detector 30 is positioned to measure characteristic of the toner mixture.

As indicated in FIG. 1, a plate or electrode 32 is positioned adjacent to the brush 10. This electrode may be any plate, surface, member, or structure used to form a capacitor with another member, such as the brush 10. One electrical connection is made between the electrode 32 and the detector 30, and a second electrical connection is made between the brush 10 and the detector 30. This electrical circuit includes the equivalent of a capacitor having one plate as the plate 32 and the other plate as the brush 10, with the developer mixture positioned between the two plates and acting as part of the dielectric of the capacitor. A close spacing, such as 0.040", would normally be maintained between the plate 32 and the brush 10. By appropriately measuring and monitoring the electrical characteristics of the capacitive circuit, the detector 30 can issue appropriate signals to control the concentration of the toner, as indicated in block 34, and to also control other variables in the development process, as indicated in block 36.

Figure 2:
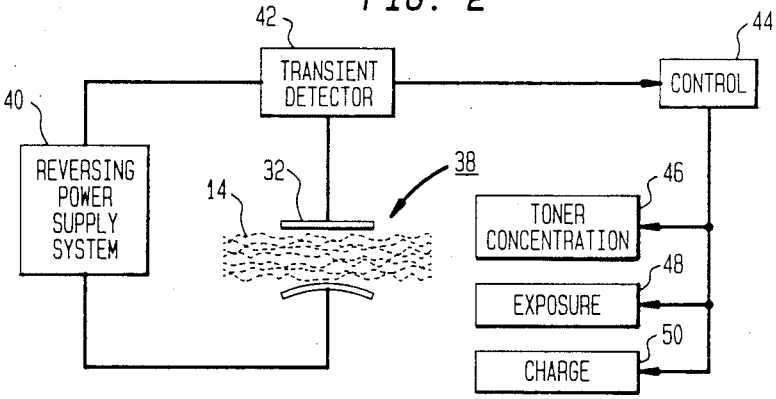
FIG. 2 is a diagram illustrating the basic form of the invention.

FIG. 2 is a block diagram illustrating the basic form of the invention. It emphasizes that the transient behavior of the capacitor 38 is used to control the toner concentration and process variables. Capacitors 38 is the equivalent circuit of the electrode or plate 32, the brush 10, and the powdered developer mixture 14 shown in FIG. 1. The reversing power supply system 40 is used to reverse the DC polarity on the capacitor plates to start a transient condition in the capacitor 38. This transient is detected by the transient detector 42 and the detection is equated to a control signal which is used by the control block 44 to control the toner concentration 46 and the process variables, such as the exposure 48 on the photosensitive member and the charge 50 on the photosensitive member and/or the toning brush 10. Controlling other quantities is also within the contemplation of the invention.

The reversing power supply system 40 reverses polarity to initiate the transient condition since the charge, current, and voltage on the capacitor 38 will reach a steady state after the polarity has been applied to the capacitor for a period of time. In effect, reversing the polarity changes the potential on the plate 32 of the capacitor 38 from a cleaning potential to a development potential. In other words, with one polarity on the plate 32, toner is developed onto the plate 32 (see FIG. 1). When the polarity is changed, the toner is cleaned from the plate 32 by repelling it from the plate and attracting it to the brush 10 where it is skived off and deposited with the toner mixture in the container 18.

In the preferred embodiment of the invention, the power supply 40 is reversed periodically during the operation of the toning device so that transients occur each time a development potential is applied to the capacitor plate 32. The transient response is measured and this measurement is used as the indication of the development rate to control the toner replenishment and process parameters. As will be indicated later herein, the transient detection can be in the form of a current, voltage, time, or charge measurement which is indicative of the instantaneous state of the capacitor 38.

Figure 3:
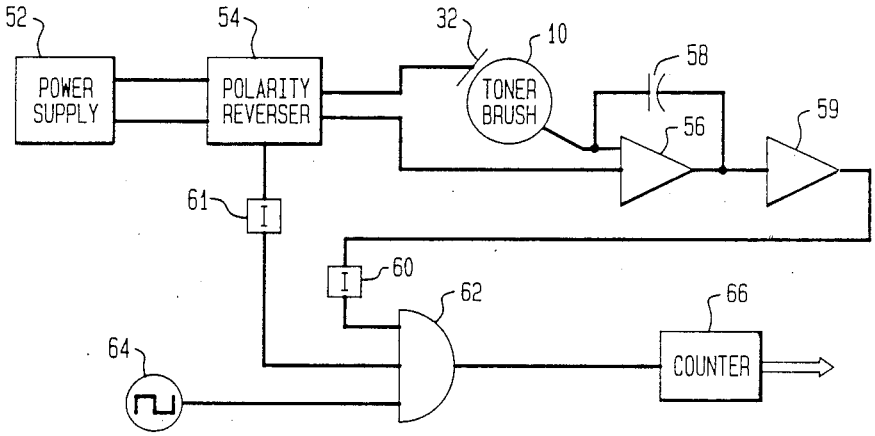
FIG. 3 is a schematic diagram of circuitry used to implement a specific embodiment of the invention.

FIG. 3 is a schematic diagram of circuitry used to implement a specific embodiment of the invention wherein a time measurement is used to indicate the transient response of the capacitor. In this specific embodiment, the time measurement corresponds to the attained charge on the capacitor. According to FIG. 3, the DC power supply 52 is connected to the polarity reverser 54. The polarity reverser 54 is used to switch the polarity between the capacitor plate or electrode 32 and the toner brush 10. Operational amplifier 56 uses the feedback capacitor 58 to form an integrating circuit which integrates the charging current existing between the plate 32 and the brush 10. When the voltage developed at the output of the amplifier 56 reaches a predetermined value, the detector 59 generates a logic signal which is transferred through the isolator 60 to the AND logic gate 62. At the instant of polarity reversal, another logic signal is supplied by the polarity reverser 54, through the isolator 61, to the AND logic gate 62. Therefore, at the time the polarity is reversed and until the circuit is triggered by detector 59, two inputs to the gate 62 are of the level needed to activate the gate 62. Consequently, the square wave generated by the square wave generator 64 is passed through the logic gate 62 to the counter 66. Thus, the counter 66 effectively counts the number of square wave pulses which occur during the time the transient behavior of the capacitor occurs until the detector 59 is activated. This count is applied to other circuitry to correlate the count with the desired amount of toner or process control. Therefore, the transient response of the capacitor has been converted into a time count which is used to control the toner development rate and concentration.

Figure 4:
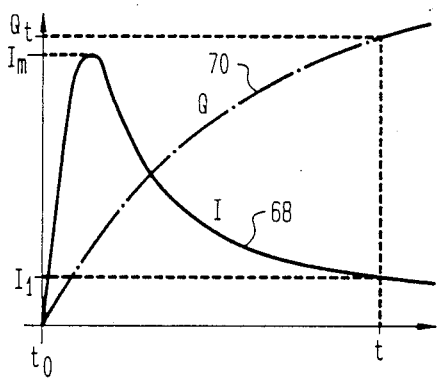
FIG. 4 is a diagraqm of current-charge characteristics of the capacitive member used in this invention.

FIG. 4 is a diagram of the current-charge characteristics of the capacitive member used in this invention. According to FIG. 4, the charging current I is indicated by curve 68 and the charge Q attained or developed on the capacitor is indicated by the curve 70. As curve 68 indicates, the current initially starts at a low value and it increases rapidly to a maximum value $I_m$. Current $I_m$ then decays at a slower rate while the charge Q on the capacitor is constantly increased, as shown by curve 70. When the current has decreased to $I_1$, the circuitry shown in FIG. 3 is triggered and the count corresponding to the time interval between $t_0$ and t is converted into a digital count number. Thus, the time required for the charging current in the capacitor to produce the charge $Q_t$ is used to determine the characteristic of the developer in the system.

Different toner concentrations and other factors which effect the toner rate of development change the time t which is needed for the charge $Q_t$ to be attained on the capacitor. It is emphasized that with the known relationships between voltage, charge, current, and time, other detection circuits may be used to indicate the transient response of the capacitor used in this invention. In other words, the transient performance or characteristics of the capacitor can be determined by other means without departing from the invention of using the transient performance to control the development rate of the apparatus.

Figure 5:
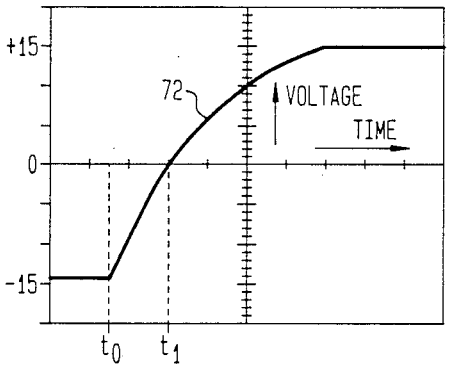
FIG. 5 is an oscillogram of the voltage-time relationship of the capacitive member used in this invention.

FIG. 5 is an oscillogram of the voltage-time relationship for the capacitor. Such a graph would be produced by connecting an oscilloscope to the output of the amplifier 56 shown in FIG. 3. Assuming supply voltages of +15 volts and −15 for the operational amplifiers in the circuit, the voltage output as a function of time is indicated by the curve 72. The charging or developing potential is applied at time $t_0$. Between times $t_0$ and $t_1$, the slope of the output curve 72 is relatively constant and is indicative of the development rate. Time $t_1$ occurs at the instant the voltage crosses the zero voltage axis. Time $t_1$ is used as the reference point for determining the transient response because of its ease in detection.

By using zero-axis time measurements as indicated in FIG. 5 with toners of known concentration levels, test results have indicated a very pronounced and accurate measurement of the toner concentration by the observed times. Table 1 below indicates test results for three different percentages of toner concentration over a period of ten different transient measurements, each occurring successively one after the other.

TABLE 1

| Replicate Number | 5% TC (msec) | 7% TC (msec) | 9% TC (msec) |
|---|---|---|---|
| 1 | 800 | 595 | 455 |
| 2 | 809 | 601 | 447 |
| 3 | 786 | 600 | 444 |
| 4 | 782 | 600 | 442 |
| 5 | 780 | 595 | 427 |
| 6 | 781 | 603 | 426 |
| 7 | 776 | 600 | 450 |
| 8 | 777 | 598 | 440 |
| 9 | 774 | 597 | 442 |
| 10 | 772 | 597 | 439 |
| Average | 784 | 599 | 441 |
| Standard Deviation | 12 | 3 | 9 |

For example the average time detected or measured for seven percent toner concentration (7% TC) was 599 milliseconds whereas the average time measured for nine percent toner concentration (9% TC) was 441 milliseconds. The difference between these average values and also the small standard deviations of the sampled values indicate the ability of the circuitry described herein to use transient response for determining and measuring the toner development rate accurately.

Figure 6:
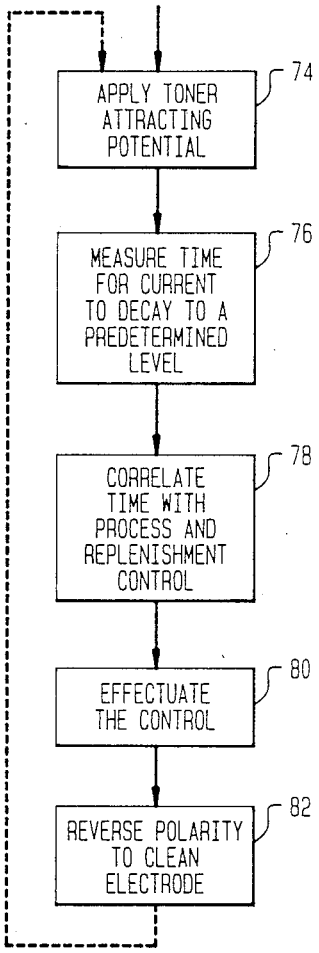
FIG. 6 is a flow chart of steps used in practicing the invention.

FIG. 6 is a flow chart illustrating steps used in practicing the invention according to the specific embodiment described herein. According to step 74, the polarity of the potential applied to the capacitor plate or electrode is switched to the attracting or developing potential. This starts the transient response at the beginning of the time measurement. The time is then measured to determine when the charging current decays to a predetermined level, as indicated in step 76. Step 78 correlates the measured time to the control action which must take place. In other words, if the time indicated that the toner concentration was below the desired level, step 78 would issue a signal which would add more toner to the toner mixture, as generally indicated in step 80. Next, as indicated in step 82, the polarity of the electrode is reversed to clean the electrode and prepare for applying the attracting potential indicated in step 74 to repeat the process again.

By repeatedly reversing the potential on the effective capacitor formed by the electrode and the toning brush, cleaning and developing voltages are applied to the capacitor plate during selected intervals of machine operation. This can be as infrequent as during initial machine start-up, or more often, such as during or between every image frame transfer. By observing the transient charging conditions occurring in the capacitor and equating these to the proper response, and improved method for detecting and controlling the toner development rate can be achieved.

It is emphasized that numerous changes may be made in the above-described system without departing from the teachings of the invention. It is intended that all of the matter contained in the foregoing description, or shown in the accompanying drawings, shall be interpreted as illustrative rather than limiting.

I claim as my invention:

1. Apparatus for controlling the development rate of an electrostatographic device using a powder toner, said apparatus comprising:
   - an electrode capacitively coupled to another member and suitably positioned to interact with toner used in the device;
   - means for applying potentials to the electrode and the other member;
   - means for charging the polarity of the potential applied to the electrode;
   - means for determining the time required for a charging current, produced when the polarity is changed, to decay to a predetermined value; and
   - means for converting the determined time into signals for controlling the development rate of the device.

2. The development rate controller of claim 1 wherein the other member is a cylindrical toning brush which supports toner and magnetic carrier particles.

3. The development rate controller of claim 1 wherein the potential on the electrode is charged from a potential which repels toner to a potential which attracts toner to produce the charging current.

4. The development rate controller of claim 1 wherein the polarity charging means includes a reversible switching means which is activated to reverse the polarity applied to the electrode and the other member.

5. The development rate controller of claim 1 wherein the determining means counts pulses for the measured time and provides the number of pulses counted to the converting means.

6. The development rate controller of claim 1 wherein the development rate is controlled by changing the concentration of the toner.

7. The development rate controller of claim 1 wherein the development rate is controlled by changing the change on the toner.

8. The development rate controller of claim 1 wherein the development rate is controlled by changing the image writing exposure on a photosensitive member in the device.

9. A method of controlling at least one development rate parameter of an electrostatographic device which uses a powered toner, said method including the steps of:
   - producing a charging current which is responsive to characteristics of the toner;
   - measuring the time needed for the charging current to decay to a predetermined value; and
   - controlling the development rate parameter based upon the measured time.

10. The development controlling method of claim 9 wherein the charging current is produced by applying a potential to an electrode with a polarity which attracts the toner, and wherein the polarity applied to the electrode is periodically reversed for cleaning the electrode.

11. The development controlling method of claim 9 wherein the time measuring includes the steps of:
   - detecting when the charging current begins; and detecting when the charging current thereafter decays to a predetermined value.

12. The development controlling method of claim 9 wherein the development rate is changed by altering the concentration of the toner.

13. The development controlling method of claim 9 wherein the development rate is charged by altering the change on the toner.

14. The development controlling method of claim 9 wherein the development rate is changed by altering the image writing exposure on a photosensitive member in the device.

15. Apparatus for controlling one or more parameters which effect the development rate of an electrostatographic device using a powdered toner which is applied to a photosensitive member by a cylindrical brush member around which the toner is deposited, said apparatus comprising:

an electrode capacitively coupled to the brush member to effectively form a capacitor, said electrode being positioned to interact with the toner on the brush member;

means for applying a potential to the electrode with a polarity which repels the toner from the electrode;

means for applying a potential to the electrode with a polarity which attracts the toner to the electrode;

means for determining the time required for the charge on the capacitor to attain a predetermined magnitude after the electrode begins to attract toner;

means for converting the determined time into signals for controlling at least one of said parameters; and means for alternating the polarity of the potential on the electrode with respect to the brush member, thereby allowing the time measurements and controlling functions to occur several times during the operation of the device.

16. A method of controlling at least one development rate parameter of an electrostatographic device which uses a powdered toner, said method including the steps of:

applying a charging potential to members which form a capacitor, with the capacitance being responsive to characteristics of the toner;

measuring the time needed for the charge on the capacitor to reach a predetermined value after the charging potential is applied; and controlling the development rate parameter based at least partially upon the measued time.

* * * * *

UNITED STATES PATENT AND TRADEMARK OFFICE

CERTIFICATE OF CORRECTION

PATENT NO. : 4,987,453

DATED : January 22, 1991

INVENTOR(S) : Joseph F. Laukaitis

It is certified that error appears in the above-identified patent and that said Letters Patent is hereby corrected as shown below:

Col. 6, line 11, Claim 1, After "a" change "powder" to --powdered--.

Col. 6, line 33, Claim 4, After "polarity" change "charging" to --changing--.

Col. 6, line 45, Claim 7, After "the" (first occurrence) change "change" to --charged--.

Col. 7, line 7, Claim 13, After "is" change "charged" to --changed--.

Col. 7, line 8, Claim 13, After "the" (first occurrence) change "change" to --charge--.

Col. 7, line 14, Claim 15, After "which" change "effect" to --affect--.

Signed and Sealed this

Twenty-fifth Day of February, 1992

*Attest:*

HARRY F. MANBECK, JR.

*Attesting Officer*

*Commissioner of Patents and Trademarks*